US007127887B2

(12) United States Patent
Nakamura et al.

(10) Patent No.: US 7,127,887 B2
(45) Date of Patent: Oct. 31, 2006

(54) OIL PRESSURE CIRCUIT FOR WORKING MACHINES

(75) Inventors: Tsuyoshi Nakamura, Ibaraki-ken (JP); Genroku Sugiyama, Ryuugasaki (JP); Tsukasa Toyooka, Ibaraki-ken (JP); Kouji Ishikawa, Ibaraki-ken (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 139 days.

(21) Appl. No.: 10/514,936

(22) PCT Filed: Mar. 15, 2004

(86) PCT No.: PCT/JP2004/003386

§ 371 (c)(1),
(2), (4) Date: Nov. 18, 2004

(87) PCT Pub. No.: WO2004/083646

PCT Pub. Date: Sep. 30, 2004

(65) Prior Publication Data

US 2006/0048508 A1 Mar. 9, 2006

(30) Foreign Application Priority Data

Mar. 17, 2003 (JP) ..... 2003-071332

(51) Int. Cl.
*F16D 31/02* (2006.01)

(52) U.S. Cl. ..... 60/421; 60/428; 60/468; 60/486; 60/494

(58) Field of Classification Search ..... 60/421, 60/428, 430, 459, 468, 486, 494
See application file for complete search history.

(56) References Cited

U.S. PATENT DOCUMENTS

| | | | | |
|---|---|---|---|---|
| 3,868,821 | A * | 3/1975 | Ratliff et al. | 60/421 |
| 3,994,133 | A * | 11/1976 | Pfeil et al. | 60/422 |
| 4,089,166 | A * | 5/1978 | Ratliff et al. | 60/421 |
| 5,442,912 | A * | 8/1995 | Hirata et al. | 60/426 |
| 5,481,872 | A * | 1/1996 | Karakama et al. | 60/421 |
| 6,192,681 | B1 * | 2/2001 | Tsuruga et al. | 60/447 |

FOREIGN PATENT DOCUMENTS

| | | |
|---|---|---|
| EP | 262098 | 3/1988 |
| EP | 629781 | 6/1994 |
| JP | 60-179504 | 9/1985 |

(Continued)

*Primary Examiner*—Hoang Nguyen
(74) *Attorney, Agent, or Firm*—Mattingly, Stanger, Malur & Brundidge, P.C.

(57) ABSTRACT

A joining directional control valve 13 is disposed to supply, to an arm cylinder 4, not only a hydraulic fluid delivered from a first hydraulic pump 1, but also a hydraulic fluid delivered from a second hydraulic pump 2 when an arm directional control valve 14 is driven. Respective delivery pressures of the hydraulic pumps 1, 2 are detected by pressure sensors 101, 102, and the opening area of a recovery control valve 6 is controlled depending on a lower one of the detected pressures from the pressure sensors 101, 102 such that, even in the combined operation of the arm cylinder 4 and another actuator 3, 4, the hydraulic fluid can be recovered for return to the arm cylinder 4 when the load pressure of the arm cylinder 4 is low. Thus, by supplying the hydraulic fluids from the two hydraulic pumps to the particular actuator for which the hydraulic fluid is to be recovered, a recovery flow rate is ensured when the load of the particular actuator is low in the combined operation.

6 Claims, 10 Drawing Sheets

FOREIGN PATENT DOCUMENTS

| | | |
|---|---|---|
| JP | 6-117411 | 4/1994 |
| JP | 6-264471 | 9/1994 |
| JP | 8-219121 | 8/1996 |
| JP | 9-210006 | 8/1997 |
| JP | 2001-355603 | 12/2001 |
| WO | WO 94/13959 | 6/1994 |

* cited by examiner

OIL PRESSURE CIRCUIT FOR WORKING MACHINES

TECHNICAL FIELD

The present invention relates to a hydraulic circuit for a working machine equipped with a hydraulic recovery system for, when a working unit of an operating mechanism, e.g., a boom, an arm or a swing body of a hydraulic excavator, is driven, reutilizing a hydraulic fluid returned from a hydraulic actuator to a reservoir for an increase in speed of the working unit. More particularly, the present invention relates to a hydraulic circuit for a working machine in which a particular actuator as a recovery target and another actuator are connected in parallel to one hydraulic pump, and which can eliminate an influence of the load of another actuator upon a recovery flow rate even in the combined operation of those actuators.

BACKGROUND ART

Regarding the above-mentioned type hydraulic circuit for a working machine, there is known a technique oriented for a hydraulic excavator in which an arm hydraulic cylinder and a swing hydraulic motor are connected in parallel to one hydraulic pump, and a hydraulic fluid drained from the arm hydraulic cylinder is recovered (see, e.g., Patent Reference 1 given below):

Patent Reference 1; PCT Laid-Open Publication WO94/13959

A hydraulic recovery system provided in that related art includes, in a line via which a reservoir-side line connecting a reservoir and a reservoir port of an arm directional control valve for controlling a flow of the hydraulic fluid supplied to the arm cylinder and a pump-side line connecting a pump port of the arm directional control valve and a hydraulic pump are communicated with each other, a check valve allowing the hydraulic fluid to flow from the reservoir-side line into the pump-side line when the pressure in the reservoir-side line is higher than that in the pump-side line, and it also includes a variable throttle valve disposed in the reservoir-side line. The hydraulic recovery system further includes a pressure sensor for detecting the delivery pressure of the hydraulic pump, a control unit for receiving a pressure signal from the pressure sensor and outputting a drive signal corresponding to the received pressure signal, and a pressure reducing valve for reducing a primary pilot pressure from a pilot pump in accordance with the drive signal from the control unit and producing a secondary pilot pressure as a control signal for the variable throttle valve.

In the related art thus constructed, when the loads acting on the swing motor and the arm cylinder are small and the pump delivery pressure is low, the control unit outputs the drive signal to the pressure reducing valve so as to provide a higher pilot pressure, whereupon the opening area of the variable throttle valve is reduced under the higher pilot pressure and the reservoir-side line is brought into a throttled state. Therefore, the hydraulic fluid drained from the arm cylinder is throttled by the variable throttle valve so that the pressure in the reservoir-side line rises. As a result, a larger part of the hydraulic fluid drained from the arm cylinder flows, as a recovered flow, into the pump-side line through the check valve and joins with the hydraulic fluid delivered from the pump, followed by being supplied again to the arm cylinder. On the other hand, when the load of the arm cylinder or the swing motor increases and the pump delivery pressure rises, the control unit outputs the drive signal to the pressure reducing valve so as to provide a lower pilot pressure, whereupon the opening area of the variable throttle valve is increased. Hence, the pressure in the reservoir-side line becomes substantially equal to the reservoir pressure and the recovery flow rate becomes substantially zero. However, because the pressure on the drain side of the arm cylinder is low, a thrust for the arm cylinder can be ensured.

Thus, with the related art described above, when the loads acting on the swing motor and the arm cylinder are small and the pump delivery pressure is low, the recovery flow rate increases, whereby the speed of the arm cylinder can be increased.

DISCLOSURE OF THE INVENTION

In the related art, however, when the excavation using the arm and the swing operation, for example, are performed at the same time, the swing load at startup is large and the pump delivery pressure rises to a very high level, whereupon the control unit outputs the drive signal to the pressure reducing valve so as to increase the opening area of the variable throttle valve. With an increase in the opening area of the variable throttle valve, as described above, the pressure in the reservoir-side line becomes substantially equal to the reservoir pressure and the recovery flow rate becomes substantially zero even when the load acting on the arm cylinder is small. For that reason, the arm speed cannot be increased.

Stated another way, the related art still has a room to be improved from the viewpoint of operability because the arm operating speed differs between the sole operation of the arm and the combined operation of the arm and swing in spite of the arm load being small in either case.

The present invention has been made in view of the above-mentioned problems with the related art, and its object is to provide a hydraulic recovery system in which hydraulic fluids from two hydraulic pumps are supplied to a particular actuator as a recovery target, and the magnitude of a load acting on the particular actuator is determined from the delivery pressures of the two hydraulic pumps, thereby ensuring a sufficient recovery flow rate when the load of the particular actuator is small in the combined operation.

To achieve the above object, the present invention provides a hydraulic circuit for a working machine comprising a first hydraulic pump for supplying a hydraulic fluid to a plurality of actuators including a particular actuator, a plurality of directional control valves including a particular directional control valve, which are connected in parallel with respect to the first hydraulic pump and control respective flows of the hydraulic fluid supplied to the plurality of actuators, a second hydraulic pump for supplying a hydraulic fluid to another actuator separate from the plurality of actuators, another directional control valve for controlling a flow of the hydraulic fluid supplied from the second hydraulic pump, and a hydraulic recovery system comprising throttle means disposed in a line connecting a reservoir port of the particular directional control valve and a reservoir, and a check valve disposed in a line connecting a reservoir-side line and a pump-side line of the particular directional control valve and allowing the hydraulic fluid to flow from the reservoir-side line to the pump-side line when the pressure in the reservoir-side line is higher than the pressure in the pump-side line, wherein the control circuit further comprises joining means for introducing the hydraulic fluid delivered from the second hydraulic pump to the particular actuator when the particular directional control valve is driven, and wherein the throttle means constituting the hydraulic recovery system is variable throttle means changing an opening area thereof in accordance with a control signal, and the hydraulic recovery system further comprises control signal generating means for generating the control signal supplied to the variable throttle means, first pressure detecting means for detecting the delivery pressure of the first hydraulic pump, second pressure detecting means for detecting the delivery pressure of the second hydraulic pump, and control means for receiving pressure signals from the first and second pressure detecting means, executing predetermined arithmetic processing, and outputting a drive signal to the control signal generating means.

With the present invention thus constructed, when the particular directional control valve is operated, the particular actuator is supplied with not only the hydraulic fluid delivered from the first hydraulic pump, but also the hydraulic fluid delivered from the second hydraulic pump through the joining means. Also, the hydraulic fluid drained from the particular actuator is introduced to the variable throttle means via the reservoir port of the particular directional control valve. As the flow rate of the hydraulic fluid introduced to the variable throttle means increases, the pressure in the reservoir-side line rises. When the pressure in the reservoir-side line becomes higher than the pressure in the pump-side line, the hydraulic fluid in the reservoir-side line flows as a recovered flow into the pump-side line through the check valve, thereby increasing the speed of the particular actuator.

On the other hand, when the delivery pressures of the first hydraulic pump and the second hydraulic pump change with a change in load of the particular actuator, those pressure changes are detected by the first pressure detecting means and the second pressure detecting means, and are then inputted to the control means. The control means executes the predetermined arithmetic processing, produces the drive signal corresponding to the inputted pressure signal, and outputs the produced drive signal to the control signal generating means. The control signal generating means produces the control signal corresponding to the drive signal and outputs the produced control signal to the variable throttle means. The variable throttle means throttles a line connected to the reservoir in accordance with the control signal, thereby controlling a recovery flow rate of the hydraulic fluid returned from the reservoir-side line to the pump-side line.

The predetermined arithmetic processing executed by the control means can be optionally set. The relationship between the pressure signal and the drive signal can be set, for example, such that a smaller one of the inputted pressure signals of the first hydraulic pump and the second hydraulic pump is selected, and the opening area of the variable throttle means increases as the selected pressure increases. With that setting, when the delivery pressure of the first or second hydraulic pump is low, this is judged as indicating that the load of the particular actuator is small. Based on such a judgment, the opening area of the variable throttle means is reduced to increase the recovery flow rate, and hence the speed of the particular actuator can be increased. On the other hand, when the delivery pressures of the first and second hydraulic pump are both high, this is judged as indicating that the load acting on the particular actuator is large. Based on such a judgment, the opening area of the variable throttle means is increased to lower the pressure in the reservoir-side line, i.e., on the drain side of the particular actuator, and hence a thrust for the actuator can be ensured.

Also, during the combined operation of the particular actuator and another actuator among the plurality of actuators supplied with the hydraulic fluid from the first hydraulic pump, even when the load of the other actuator is large and the delivery pressure of the first hydraulic pump is high, the delivery pressure of the second hydraulic pump is low if the load of the particular actuator is small. Therefore, the control unit outputs the drive signal to the control signal generating means so as to increase the recovery flow rate.

Accordingly, when the load of the particular actuator is small even in the combined operation, a recovery flow rate can be ensured and the speed of the particular actuator can be increased. As a result, in any of the sole operation and the combined operation, the operating speed of the particular actuator can be made substantially equal to each other and satisfactory operability can be obtained.

BEST MODE FOR CARRYING OUT THE INVENTION

Figure 1:
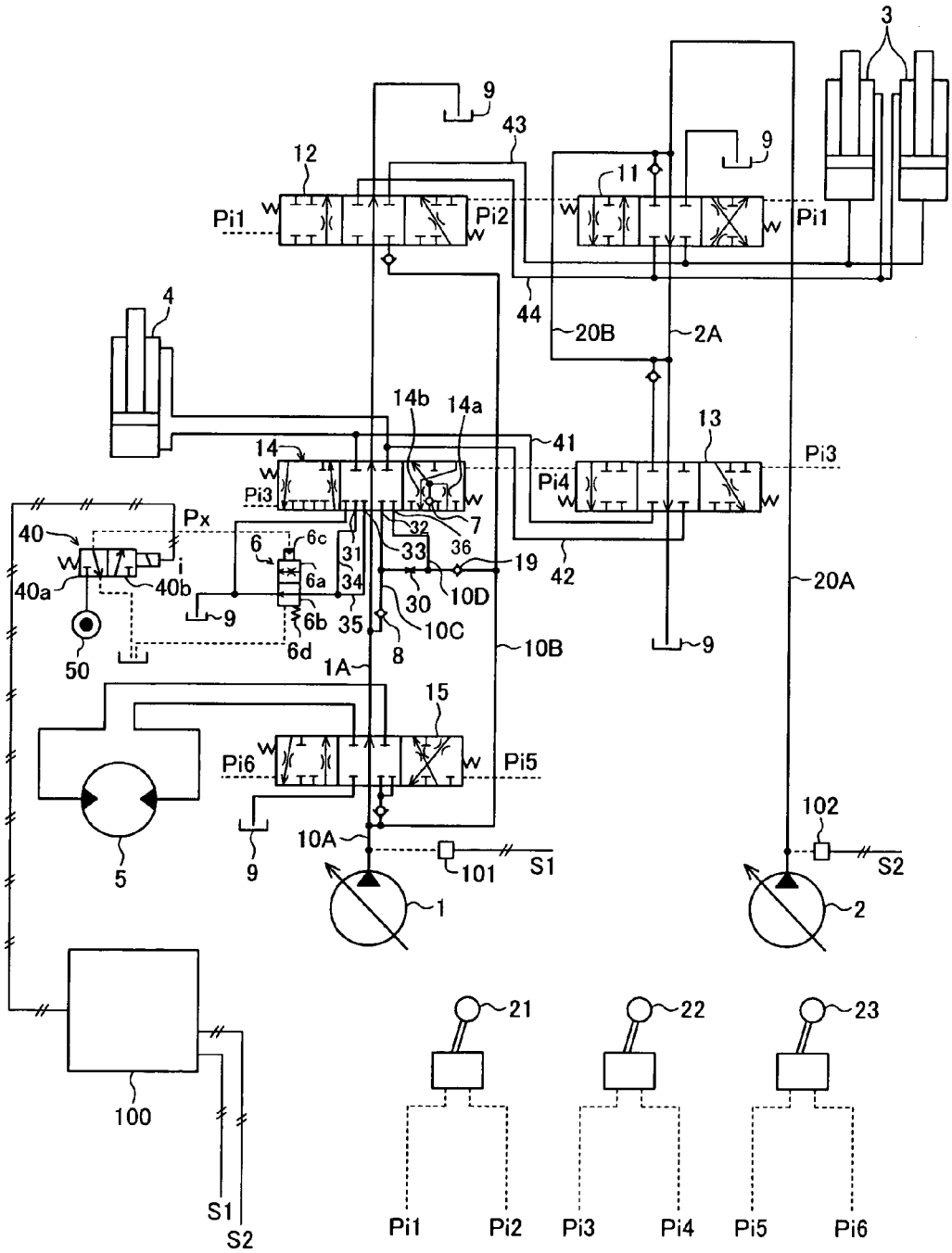
FIG. 1 is an overall hydraulic circuit diagram of a first embodiment of the present invention.
Figure 2:
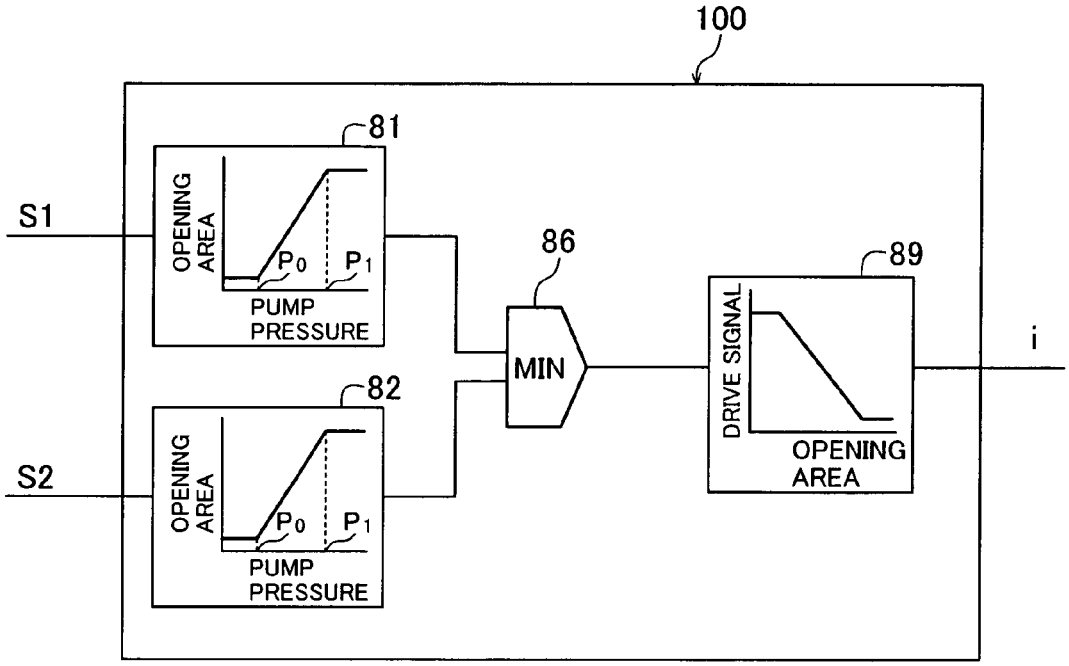
FIG. 2 is a block diagram of a control unit in the first embodiment.
Figure 3:
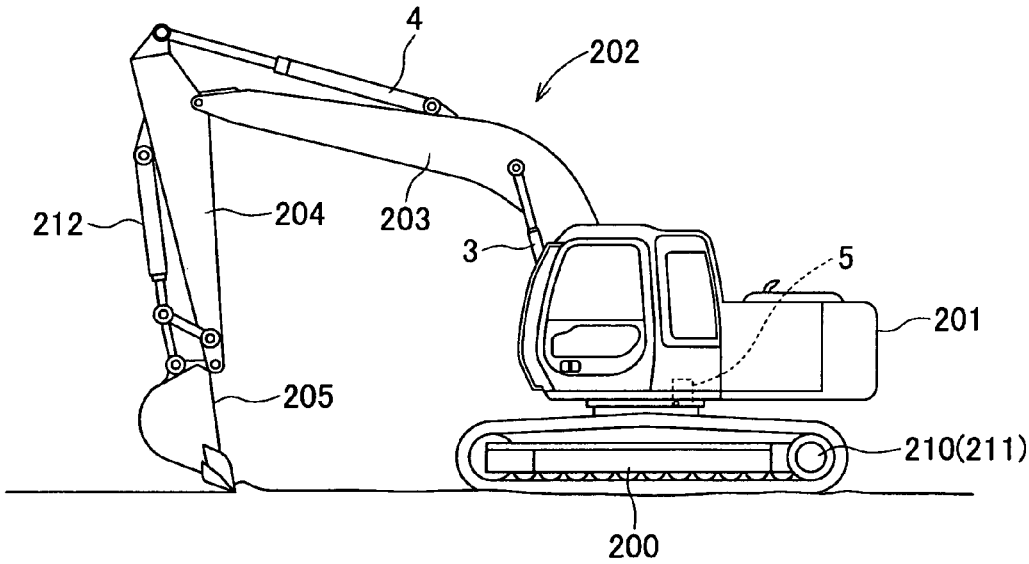
FIG. 3 shows an external appearance of a hydraulic excavator equipped with the hydraulic circuit.
Figure 4:
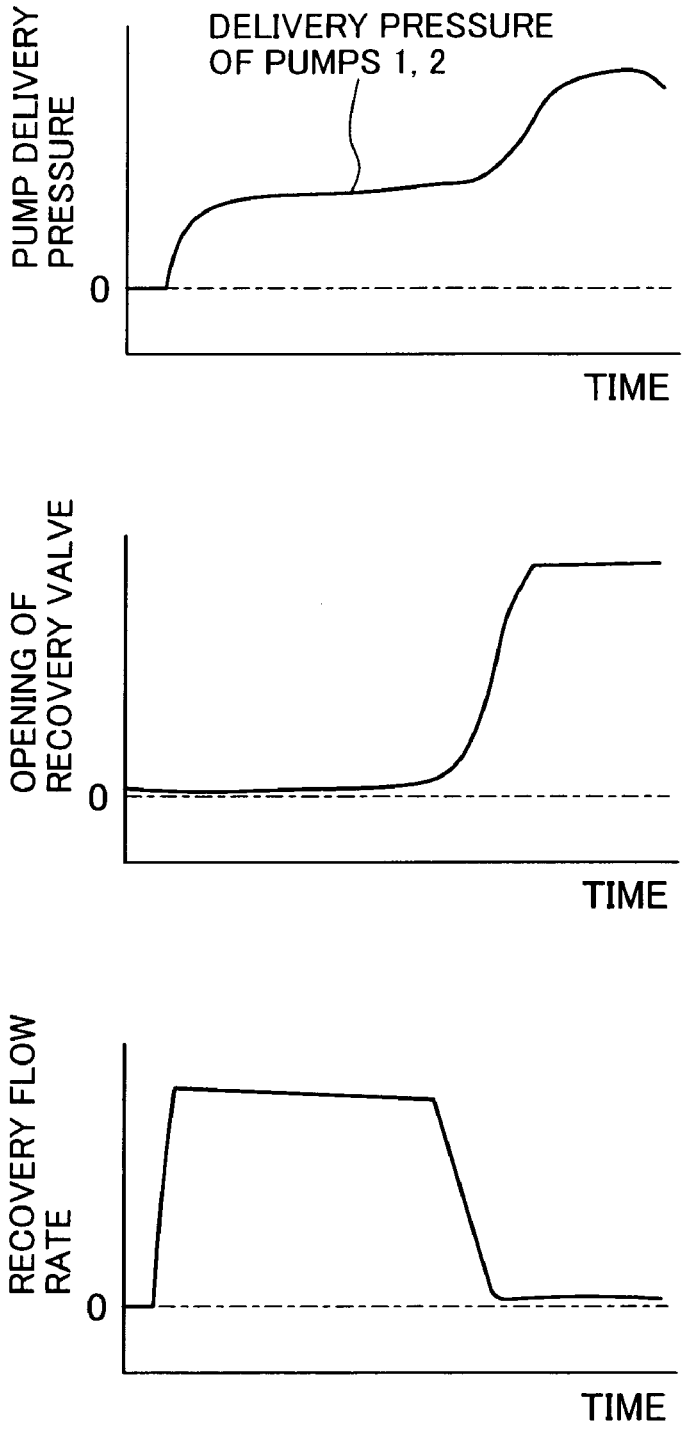
FIG. 4 is a graph showing the relationship between the pump delivery pressure and the recovery flow rate during the sole operation of an arm in the first embodiment.
Figure 5:
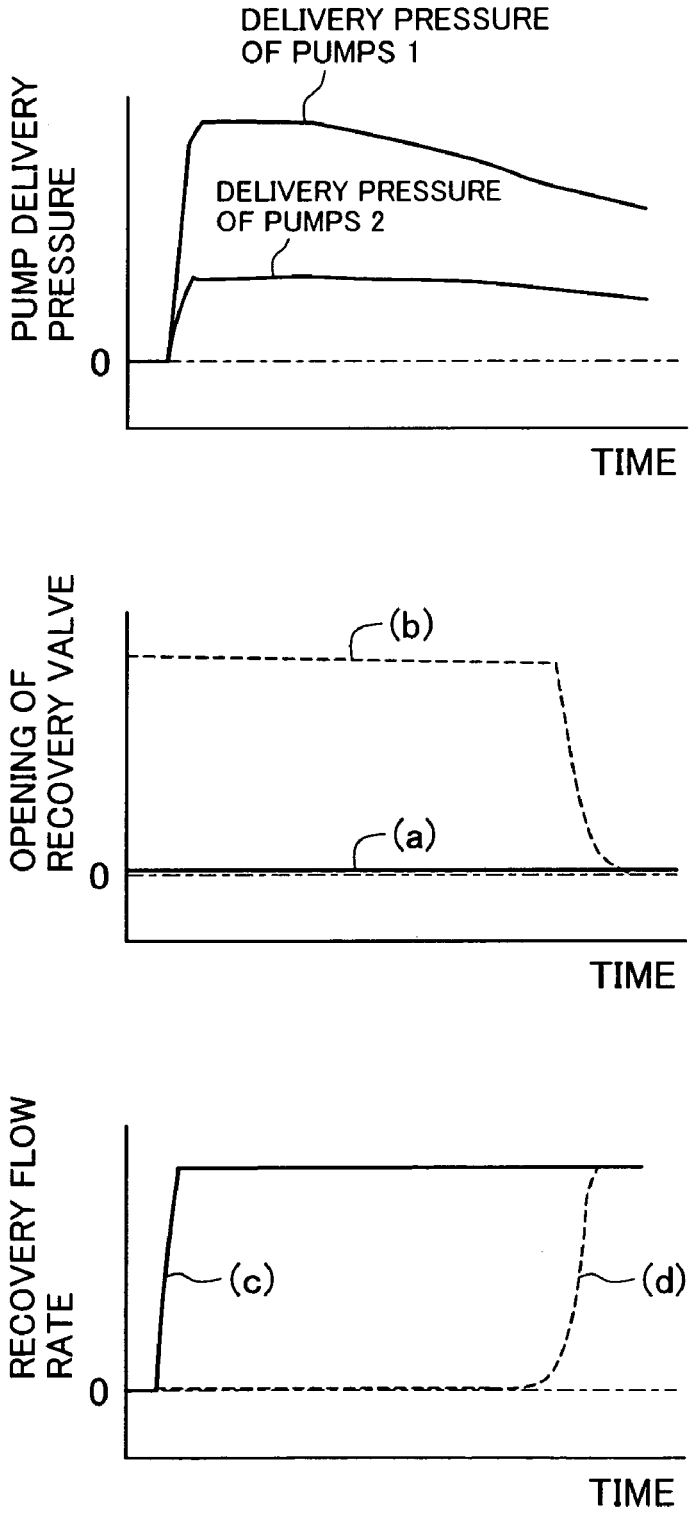
FIG. 5 is a graph showing the relationship between the pump delivery pressure and the recovery flow rate during the arm and swing combined operation in the first embodiment.

Embodiments of a hydraulic circuit for a working machine according to the present invention will be described below with reference to the drawings. In the embodiments, the present invention is applied to a not-shown hydraulic excavator as one example of the working machine. FIGS. 1 to 5 are attached for explaining the first embodiment. More specifically, FIG. 1 is an overall hydraulic circuit diagram, and FIG. 2 is a block diagram of a control unit. FIG. 3 shows an external appearance of a hydraulic excavator equipped with the hydraulic circuit. FIGS. 4 and 5 are graphs showing the relationships of the pump delivery pressure versus the opening area of a recovery control valve serving as variable throttle means and the recovery flow rate, respectively, during the arm sole operation and during the arm and swing combined operation.

As shown in FIG. 1, the hydraulic circuit of this first embodiment comprises an arm cylinder 4 for driving an arm 204 (see FIG. 3) constituting a part of the hydraulic excavator, a swing motor 5 for driving a swing body 201 (see FIG. 3), a boom cylinder 3 for driving a boom 203 (see FIG. 3), a variable displacement hydraulic pump 1 serving as a first hydraulic pump and supplying a hydraulic fluid primarily to the arm cylinder 4 and the swing motor 5, an arm directional control valve 14 and a swing directional control valve 15 for controlling respective flows of the hydraulic fluid delivered from the hydraulic pump 1 and supplied to the arm cylinder 4 or the swing motor 5, a variable displacement hydraulic pump 2 serving as a second hydraulic pump and supplying a hydraulic fluid primarily to the boom cylinder 3, and a boom directional control valve 11 for controlling a flow of the hydraulic fluid delivered from the hydraulic pump 2 and supplied to the boom cylinder 3. Further, the hydraulic circuit comprises a directional control valve 13 serving as joining means for joining the hydraulic fluid delivered from the hydraulic pump 2 with the hydraulic fluid delivered from the hydraulic pump 1 and supplying the joined hydraulic fluid to the arm cylinder 4 when the arm directional control valve 14 is operated by an operating device 22, and a directional control valve 12 for joining the hydraulic fluid delivered from the hydraulic pump 1 with the hydraulic fluid delivered from the hydraulic pump 2 and supplying the joined hydraulic fluid to the boom cylinder 3 when the boom directional control valve 11 is operated by an operating device 21.

The directional control valves 12, 14 and 15 are each a center bypass valve through which a center bypass line 1A communicating the hydraulic pump 1 and a reservoir 9 with each other penetrates. Those directional control valves 12, 14 and 15 are connected in parallel via a delivery line 10A of the hydraulic pump 1 and a pump line 10B. Also, the directional control valves 11, 13 are each a center bypass valve through which a center bypass line 2A communicating the hydraulic pump 2 and the reservoir 9 with each other penetrates. Those directional control valves 11, 13 are connected in parallel via a delivery line 20A of the hydraulic pump 2 and a pump line 20B.

The swing directional control valve 15 is operated by pilot pressures Pi5, Pi6 produced from a control lever unit 23, the arm directional control valve 14 and the directional control valve 13 are each operated by pilot pressures Pi3, Pi4 produced from the control lever unit 22, and the boom directional control valves 11, 12 are each operated by pilot pressures Pi1, Pi2 produced from the control lever unit 21. Herein, when the arm control lever unit 22 is operated, respective spools of the directional control valve 14 and the directional control valve 13 are moved, whereupon the hydraulic fluid from the hydraulic pump 1 is supplied to the arm cylinder 4 via a later-described second line 10C and the pump line 10B, and at the same time the hydraulic fluid from the hydraulic pump 2 is also supplied to the arm cylinder 4 via the pump line 20B, the directional control valve 13, and a line 41 or 42. Also, when the boom control lever unit 21 is operated, respective spools of the directional control valve 11 and the directional control valve 12 are moved, whereupon the hydraulic fluid from the hydraulic pump 2 is supplied to the boom cylinder 3 via the directional control valve 11, and at the same time the hydraulic fluid from the hydraulic pump 1 is also supplied to the boom cylinder 3 via the pump line 10B, the directional control valve 12, and a line 43 or 44. As typically shown by the directional control valve 14, each of the directional control valves 11, 14 and 15 has a meter-in variable throttle 14*a* and a meter-out variable throttle 14*b* each having an opening area that is throttled at an extent depending on the shift amount of the corresponding spool.

The arm directional control valve 14 has a reservoir port 31 connected to the reservoir 9 via a first line 34 serving as a drain line, a pump port 32 that is connected to the pump line 10B via a second line 10C serving as a feeder line, a check valve 19 and a throttle 30 and is also connected to the center bypass line 1A via the second line 10C and a check valve 8, and a pump port 36 connected to the pump line 10B via a third line 10D serving as a feeder line and the check valve 19. The check valve 19 is disposed to prevent the hydraulic fluid from flowing backward from the second line 10C to the pump line 10B. Also, the throttle 30 is disposed such that, during the simultaneous swing and arm operation, the hydraulic fluid delivered from the hydraulic pump 1 is satisfactorily supplied to both the swing motor 5 having a large load and the arm cylinder 4 tending to have a smaller load than the swing motor 5.

A hydraulic recovery system according to this embodiment is additionally provided in the thus-constructed hydraulic circuit for the hydraulic excavator. The hydraulic recovery system comprises a recovery control valve 6 serving as variable throttle means and disposed in the first line 34, a third line 35 for recovery extending from the recovery control valve 6 toward the upstream and communicating with the bottom side of the arm cylinder 4, and a check valve 7 disposed in the directional control valve 14 and allowing the hydraulic fluid to flow only in a direction from the first line 34 toward the bottom side of the arm cylinder 4.

The recovery control valve 6 includes a spool 6*b* formed with a variable throttle 6*a*, a hydraulic driving sector 6*c* to which a pilot pressure Px is introduced as a control signal to drive the spool 6*b* in the valve closing direction, and a spring 6*d* for biasing the spool 6*b* in the valve opening direction. The opening area of the variable throttle 6*a* is set at a position where the pilot pressure Px introduced to the hydraulic driving sector 6*c* is balanced by the biasing force applied from the spring 6*d*.

The hydraulic recovery system further comprises pressure sensors 101, 102 for detecting respective delivery pressures of the hydraulic pump 1 and the hydraulic pump 2, a solenoid proportional valve 40 serving as control signal generating means that reduces the primary pilot pressure delivered from a pilot pump 50 and produces the pilot pressure Px supplied to the recovery control valve 6, and control means 100 for receiving respective pressure signals S1, S2 from the pressure sensors 101, 102, producing a drive signal in accordance with the received pressure signals, and outputting the drive signal to the solenoid proportional valve 40.

The control unit 100 comprises, as shown in FIG. 2, a first processing unit 81 for computing a target opening area corresponding to the received pressure signal S1 of the hydraulic pump 1 in accordance with the preset relationship between the delivery pressure of the hydraulic pump 1 and the target opening area of the recovery control valve 6, a second processing unit 82 for computing a target opening area corresponding to the received pressure signal S2 of the hydraulic pump 2 in accordance with the preset relationship between the delivery pressure of the hydraulic pump 2 and the target opening area of the recovery control valve 6, a third processing unit 86 for selecting a smaller one of the target opening areas of the recovery control valve 6 computed by the first processing unit 81 and the second processing unit 82, and a fourth processing unit 89 for outputting a drive current i as the drive signal to the solenoid proportional valve 40 in accordance with the target opening area outputted from the third processing unit 86. The first processing unit 81 and the second processing unit 82 each have a characteristic set such that the target opening area is held at a minimum until the delivery pressure of corresponding one of the hydraulic pump 1 and the hydraulic pump 2 rises to a predetermined low pressure P0, and the target opening area gradually increases up to a maximum until reaching a predetermined high pressure P1. Further, the fourth processing unit 89 has a characteristic set such that the drive current i supplied to the solenoid proportional valve 40 reduces as the target opening area increases.

FIG. 3 shows an external appearance of the hydraulic excavator equipped with the hydraulic circuit described above. The hydraulic excavator comprises a lower travel structure 200, an upper swing body ("swing body" is also referred to as "swing" in this description) 201, and a front operating mechanism 202. The front operating mechanism 202 is made up of a boom 203, an arm 204, and a bucket 205. The lower travel structure 200 includes, as driving means, left and right travel motors 210, 211 (only one of them being shown in FIG. 3), and the upper swing body 201 is driven by the swing motor 5, shown in FIG. 1, to swing horizontally on the lower travel structure 200. The boom 203 is supported to a front central portion of the upper swing body 201 rotatably in the vertical direction and is driven by the boom cylinder 3 shown in FIG. 1. The arm 204 is supported to a fore end of the boom 203 rotatably in the back-and-forth direction and is driven by the arm cylinder 4 shown in FIG. 1. The bucket 205 is supported to a fore end of the arm 204 rotatably in the back-and-forth direction and is driven by the bucket cylinder 212. In the hydraulic circuit shown in FIG. 1, the travel motors 210, 211 and the bucket cylinder 212 are omitted.

In the thus-constructed hydraulic circuit for the working machine according to this embodiment, when the control lever unit 22, for example, is operated to produce the pilot pressure Pi4 and the directional control valves 13, 14 are shifted, the hydraulic fluid delivered from the hydraulic pump 1 flows into the bottom side of the arm cylinder 4 from the pump port 32 via the delivery line 10A, the check valve 8, and the second line 10C. Simultaneously, the hydraulic fluid delivered from the hydraulic pump 2 is also supplied to the bottom side of the arm cylinder 4 via the delivery line 20A, the center bypass line 2A or the pump line 20B, the directional control valve 13, and the line 41.

In the case of driving the arm cylinder 4 in such a way, when the arm 204 is solely operated with the arm 204 held in a vertically downward posture, for example, the load applied to the arm cylinder 4 is almost equal to that in a non-load state and the bottom-side pressure of the arm cylinder 4 becomes very low, whereby both the delivery pressures of the hydraulic pump 1 and the hydraulic pump 2 also become very low. Therefore, the pressure signals S1, S2 inputted to the control unit 100 from the pressure sensors 101, 102 are each a low pressure signal, and the target opening area outputted from the third processing unit 86 takes a value close to its minimum one. Accordingly, the fourth processing unit 89 computes, as the drive signal i supplied to the solenoid proportional valve 40, a current value close to its maximum one corresponding to the inputted target opening area. Upon receiving the drive signal i, the solenoid proportional valve 40 shifts its valve position from 40*a* to 40*b* and takes a nearly maximum opening area so that the pilot pressure Px almost equal to the primary pilot pressure is introduced to the recovery control valve 6. The pilot pressure Px moves the spool 6*b* of the recovery control valve 6 in the throttling direction to reduce the opening area thereof down to nearly its minimum value, whereby the hydraulic fluid drained from the rod side of the arm cylinder 4 is throttled by the recovery control valve 6 and the pressure in the first line 34 rises. Then, when the pressure in the first line 34 rises beyond the pressure in the second line 10C, a part of the return hydraulic fluid flowing out from the reservoir port 31 into the first line 34 is forced to join with the hydraulic fluid delivered from the hydraulic pump 1, as a recovered flow, via the third line 35, the recovery port 33, and the check valve 7, followed by being supplied to the bottom side of the arm cylinder 4. Consequently, the moving speed of the arm cylinder 4 increases.

FIG. 4 shows the relationship between the delivery pressure of the hydraulic pump 1, 2 and the recovery flow rate in the above case. As shown in FIG. 4, when the arm control lever unit 22 is operated to open the directional control valves 13, 14, the respective pressures of the hydraulic pumps 1, 2 increase with the load applied to the arm cylinder 4. In the state of the arm 204 being held in a vertically downward posture, as described above, the load of the arm cylinder 4 is small and both the delivery pressures of the hydraulic pump 1 and the hydraulic pump 2 are low. During such a period, therefore, the opening area of the recovery control valve 6 is nearly minimized and the hydraulic fluid drained from the rod side of the arm cylinder 4 is throttled, whereby the pressure in the first line 34 rises and the recovery flow rate increases. Then, as the rod of the arm cylinder 4 is extended and the posture of the arm 204 changes, the load of the arm cylinder 4 increases and both the delivery pressures of the hydraulic pump 1 and the hydraulic pump 2 rise. Correspondingly, the drive current i outputted from the control unit 100 to the solenoid proportional valve 40 reduces and the opening area of the recovery control valve 6 increases. As a result, the pressure in the first line 34 lowers and the recovery flow rate reduces. At this time, however, because the rod-side pressure of the arm cylinder 4 is already low, a thrust for the arm cylinder 4 is ensured.

On the other hand, when the swing control lever unit 23 is operated at the same time as when the arm control lever unit 22 is operated to produce the pilot pressure Pi4, the hydraulic fluid delivered from the hydraulic pump 1 is supplied to the swing motor 5 via the delivery line 10A and the directional control valve 15, and the hydraulic fluid delivered from the hydraulic pump 1 is also supplied to the bottom side of the arm cylinder 4 via the pump line 10B, the check valve 19, the throttle 30, the second line 10C, and the pump port 32. At this time, in particular, immediately after the swing operation, a large load acts on the swing motor 5 and the pressure at the swing motor 5 becomes higher than the bottom-side pressure of the arm cylinder 4. However, the hydraulic fluid delivered from the hydraulic pump 1 is supplied to both the actuators 4, 5 under the action of the throttle 30. Further, the hydraulic fluid delivered from the hydraulic pump 2 is supplied to the bottom side of the arm cylinder 4 through the directional control valve 13 in the same way as described above.

Here, because of a large load acting on the swing motor 5 as described above, the delivery pressure of the hydraulic pump 1 is high, while the delivery pressure of the hydraulic pump 2 is low when the load of the arm cylinder 4 is small. Therefore, the high pressure signal S1 and the low pressure signal S2 are inputted to the control unit 100 respectively from the pressure sensor 101 and the pressure sensor 102. The first processing unit 81 computes a large value as the target opening area corresponding to the high pressure signal S1, the second processing unit 82 computes a small value as the target opening area corresponding to the low pressure signal S2, and the third processing unit 86 selects a smaller one of the two pressure signals. Then, the fourth processing unit 89 computes a large drive current i corresponding to the small value of the target opening area. Accordingly, the control unit 100 outputs, to the solenoid proportional valve 40, the large drive current i corresponding to the low pressure signal S2. As a result, the opening area of the recovery control valve 6 reduces and the flow rate of the hydraulic fluid recovered from the first line 34 increases in the same manner as described above.

FIG. 5 shows the process in the foregoing case. As described above, the delivery pressure of the hydraulic pump 1 is high because the load of the swing motor 5 is large, whereas the delivery pressure of the hydraulic pump 2 is low because the load of the arm cylinder 4 is small. At this time, the recovery control valve 6 is controlled to reduce its opening area, as indicated by a solid line (a), in accordance with the low delivery pressure of the hydraulic pump 2. Correspondingly, the recovery flow rate increases as indicated by a solid line (c).

In the control executed in the above-described related art, since the recovery control valve is controlled in accordance with the high delivery pressure of the hydraulic pump 1, the recovery flow rate is substantially zero during a period in which the delivery pressure of the hydraulic pump 1 is held in a high pressure state, as indicated by broken lines (b) and (d).

With this embodiment, therefore, when the load of the arm cylinder 4 is small even in the combined operation of the swing 201 and the arm 204, a large recovery flow rate can be ensured for return to the bottom side of the arm cylinder 4 and the operating speed of the arm cylinder 4 can be increased. As a result, in any of the arm sole operation and the arm and swing combined operation, the hydraulic fluid can be recovered for return to the arm cylinder 4 and satisfactory operability can be obtained. Hence, working efficiency also increases. Additionally, by adjusting respective degrees of throttling of the joining directional control valves 12, 13, a similar effect to that described above can also be obtained in the combined operation of the arm 204 and the boom 203.

Figure 6:
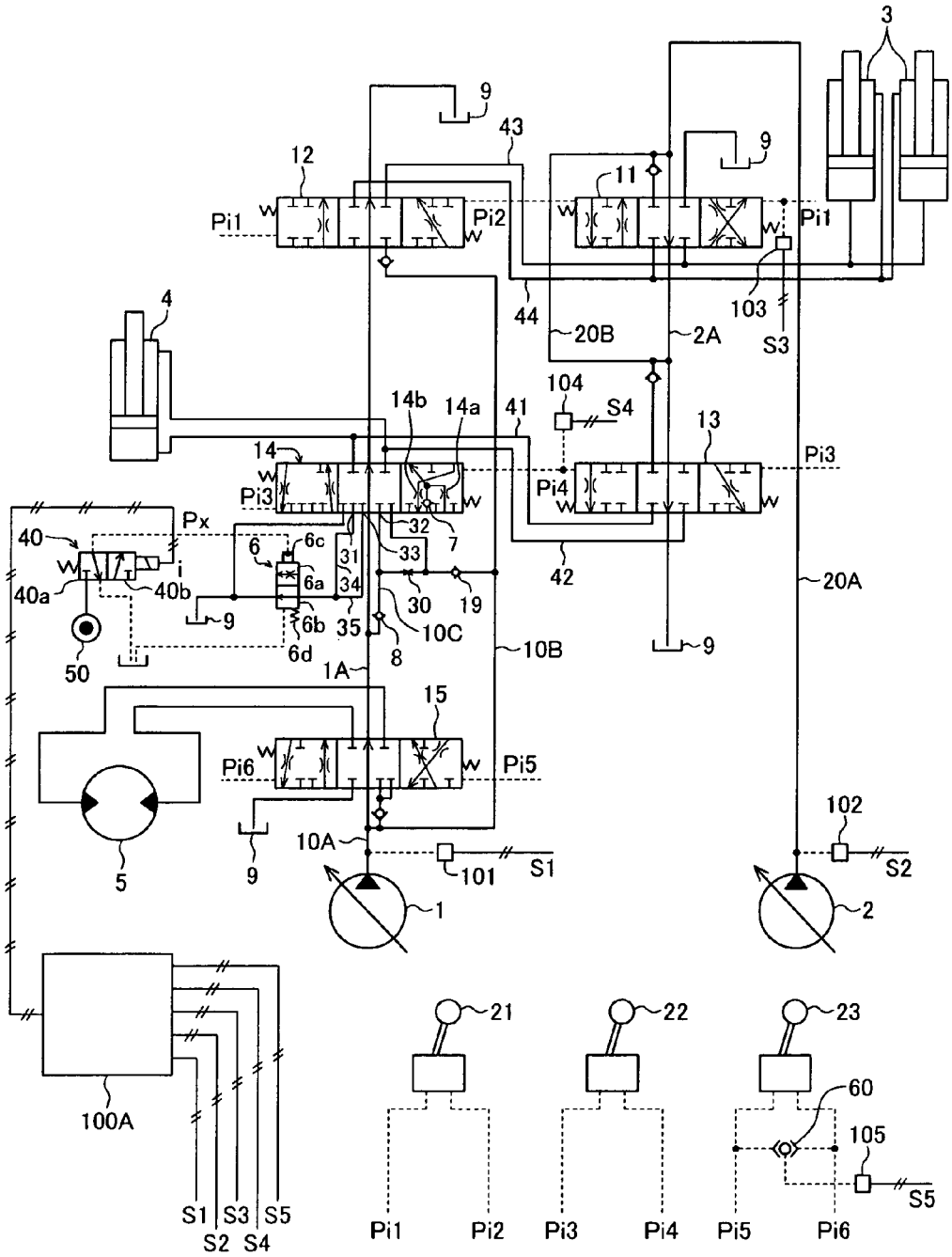
FIG. 6 is an overall hydraulic circuit diagram of a second embodiment of the present invention.
Figure 7:
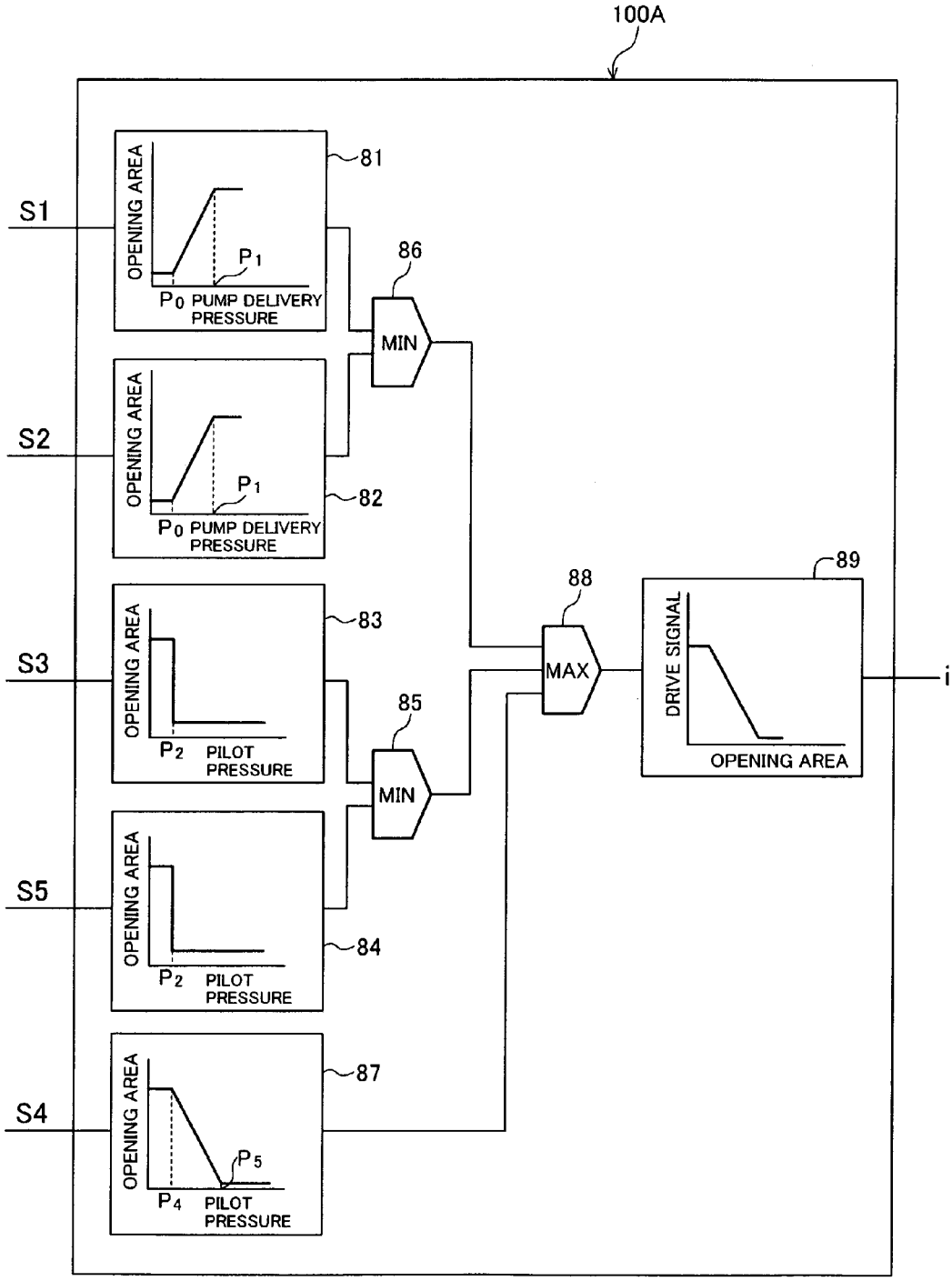
FIG. 7 is a block diagram of a control unit in the second embodiment.
Figure 8:
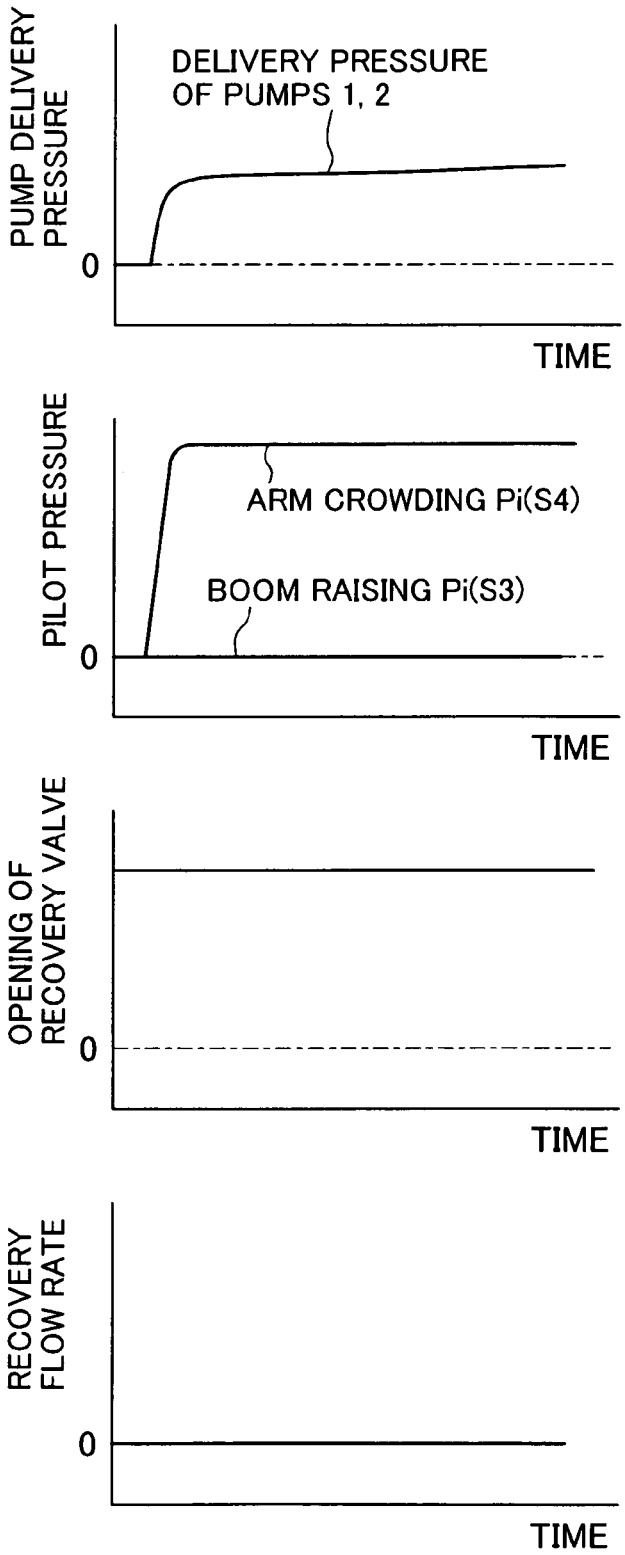
FIG. 8 is a graph showing the relationship between the pump delivery pressure and the recovery flow rate during the sole operation of an arm in the second embodiment.
Figure 9:
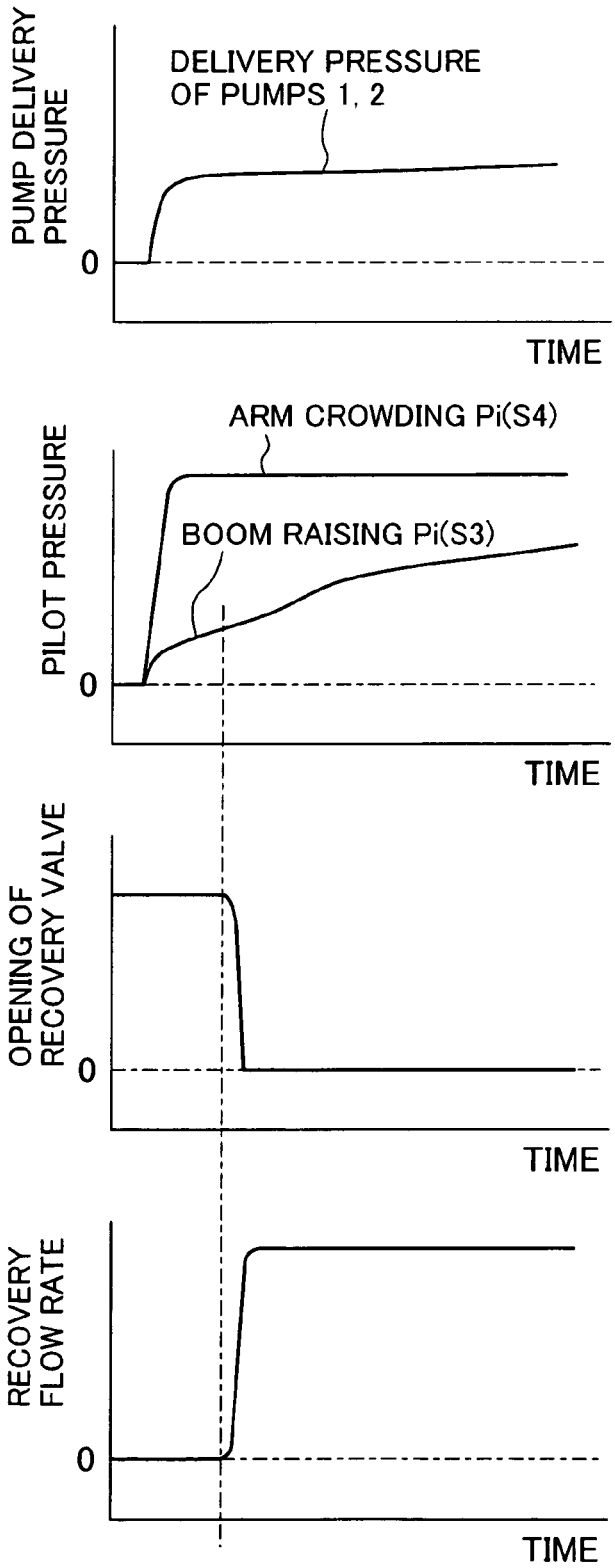
FIG. 9 is a graph showing the relationship between the pump delivery pressure and the recovery flow rate during the arm and boom combined operation in the second embodiment.

A second embodiment of the present invention will be described below with reference to FIGS. 6 to 9. In view of the possibility that when the hydraulic fluid is recovered during the arm sole operation, the arm driving speed is increased in excess of a necessary level because the hydraulic fluids from the two hydraulic pumps 1, 2 are joined with each other and supplied to the arm cylinder 4, this second embodiment is intended to perform recovery of the hydraulic fluid only when the arm load pressure is low during the combined operation of the arm and another actuator. FIG. 6 is an overall hydraulic circuit diagram of the second embodiment, and FIG. 7 is a block diagram of a control unit in the second embodiment. FIGS. 8 and 9 are each a graph showing the relationships of the pump delivery pressure and the operating pilot pressure versus the opening area of the recovery control valve and the recovery flow rate.

In this second embodiment, as shown in FIG. 6, pilot pressure sensors 103, 104 and 105 are additionally provided as operation input detecting means to detect pilot pressures outputted from the control lever units 21, 22 and 23 for operating the respective actuators 3, 4 and 5. Respective pilot pressure signals S3, S4 and S5 from the pilot pressure sensors 103, 104 and 105 are inputted to a control unit 100A. The control unit 100A executes later-described arithmetic processing based on not only the pressure signals S1, S2 of the hydraulic pumps 1, 2, but also the pilot pressure signals S3, S4 and S5. The pilot pressure sensor 103 is disposed so as to detect the pilot pressure Pi1 for instructing the supply of the hydraulic fluid to the bottom side of the boom cylinder 3, the pilot pressure sensor 104 is disposed so as to detect the pilot pressure Pi4 for instructing the supply of the hydraulic fluid to the bottom side of the arm cylinder 4, and the pilot pressure sensor 105 is disposed so as to detect a higher one of the pilot pressures Pi5, Pi6 for driving the swing motor 5 through a shuttle valve 60.

As shown in FIG. 7, the control unit 100A comprises, in addition to the first processing unit 81, the second processing unit 82, the third processing unit 86, and the fourth processing unit 89 which are used in the above-described first embodiment, a fifth processing unit 83 for computing a target opening area corresponding to the inputted pilot pressure signal S3 in accordance with the preset relationship between the pilot pressure Pi1 for driving the boom cylinder 3 and the target opening area of the recovery control valve 6, a sixth processing unit 84 for computing a target opening area corresponding to the inputted pilot pressure signal S5 in accordance with the preset relationship between the pilot pressure Pi5 or Pi6 for driving the swing motor 5 and the target opening area of the recovery control valve 6, a seventh processing unit 85 for selecting a smaller one of the target opening areas computed by the fifth processing unit 83 and the sixth processing unit 84, an eighth processing unit 87 for computing a target opening area corresponding to the inputted pilot pressure signal S4 in accordance with the preset relationship between the pilot pressure Pi4 for driving the arm cylinder 4 and the target opening area of the recovery control valve 6, and a ninth processing unit 88 for selecting a maximum one of the target opening areas computed by the third processing unit 86, the seventh processing unit 85 and the eighth processing unit 87.

The fifth processing unit 83 and the sixth processing unit 84 each have a characteristic set such that the target opening area is held at a maximum until corresponding one of the pilot pressure Pi1 for driving the boom cylinder 3 and the pilot pressures Pi5 or Pi6 for driving the swing motor 5 rises to a predetermined low pressure P2, and the target opening area reduces down to a minimum after the predetermined pressure P2 is exceeded. Further, the eighth processing unit 87 has a characteristic set such that the target opening area is held at a maximum until the pilot pressure Pi4 for driving the arm cylinder 4 rises to a predetermined low pressure P4, and the target opening area gradually reduces down to a minimum until reaching a predetermined high pressure P5.

In the second embodiment thus constructed, when the control lever unit 22 is operated to the right, as viewed in the drawing, for supplying the hydraulic fluid to extend the arm cylinder 4 alone, i.e., in the direction toward the bottom side of the arm cylinder 4, the pilot pressure Pi4 is supplied to the directional control valves 13, 14, and the supplied pilot pressure Pi4 is detected by the pilot pressure sensor 104. When the pilot pressure signal S4 is inputted to the control unit 100A, the eighth processing unit 87 computes the target opening area of the recovery control valve 6 corresponding to the inputted pilot pressure signal S4. Also, when the delivery pressures of the hydraulic pumps 1, 2 rise with the continued driving of the arm cylinder 4, the first processing unit 81 and second processing unit 82 compute the respective target opening areas based on the pump delivery pressure signals S1, S2, and the third processing unit 86 outputs a smaller one of the target opening areas outputted from the first processing unit 81 and the second processing unit 82.

Here, when only the arm control lever unit 22 is operated, the boom driving pilot pressure Pi1 and the swing driving pilot pressures Pi5 or Pi6 are held substantially at the reservoir pressure. Therefore, the target opening areas outputted from the fifth processing unit 83 and the sixth processing unit 84 take their maximum values, and hence the target opening area outputted from the seventh processing unit 85 also takes its maximum value. Then, the ninth processing unit 88 selects a maximum value among the target opening areas computed by the third processing unit 86, the seventh processing unit 85, and the eighth processing unit 87. Accordingly, in the case of the arm sole operation, the maximum target opening area is selected regardless of the target opening areas computed based on the pilot pressure signal S4 and the delivery pressure signals S1, S2 of the hydraulic pumps 1, 2, and the fourth processing unit 89 outputs a minimum drive signal i corresponding to the maximum opening area. When the minimum drive signal i is inputted to the solenoid proportional valve 40, the pilot pressure Px outputted from the solenoid proportional valve 40 takes a low level substantially equal to the reservoir pressure, and the recovery control valve 6 holds its maximum opening area. As a result, the pressure in the first line 34 becomes substantially equal to the reservoir pressure, and the recovery flow rate of the hydraulic fluid returned from the first line 34 to the bottom side of the arm cylinder 4 becomes substantially zero.

FIG. 8 shows the relationship between the hydraulic pump 1, 2 and the recovery flow rate in the above case. As shown in FIG. 8, when the arm control lever unit 22 is operated to open the directional control valves 13, 14, the respective pressures of the hydraulic pumps 1, 2 increase with the load applied to the arm cylinder 4. However, since the target opening area outputted from the ninth processing unit 88 has nearly its maximum value, the opening area of the recovery control valve 6 takes its maximum value. Consequently, most of the hydraulic fluid drained from the arm cylinder 4 flows into the reservoir 9 and the recovery flow rate is substantially zero.

Thus, with this second embodiment, the hydraulic fluid is not recovered to the arm cylinder 4 during the arm sole operation.

On the other hand, when the arm 204 and the boom 203 or the swing 201 are operated at the same time, the target opening area outputted from any one of the fifth processing unit 83 and the sixth processing unit 84 takes its minimum value, and hence the target opening area outputted from the seventh processing unit 85 also takes its minimum value. To the contrary, the pilot pressure signal S4 increases with the operation of the arm control lever unit 22, and the eighth processing unit 87 outputs a small target opening area. Also, the third processing unit 86 outputs the target opening area corresponding to a lower one of the delivery pressures of the hydraulic pump 1 and the hydraulic pump 2. Accordingly, when the load pressure of the arm cylinder 4 is low, any one of the delivery pressures of the hydraulic pump 1 and the hydraulic pump 2 lowers and the target opening area outputted from the third processing unit 86 takes a small value. Thus, all the target opening areas outputted from the third processing unit 86, the seventh processing unit 85, and the eighth processing unit 87 take the small values, whereby the ninth processing unit 88 outputs a small value as the target opening area and the fourth processing unit 89 outputs a large drive current i. Upon receiving the large drive signal i, the solenoid proportional valve 40 outputs a high pilot pressure Px to the recovery control valve 6, whereby the opening area of the recovery control valve 6 reduces. As a result, the hydraulic fluid drained from the rod side of the arm cylinder 4 is throttled to raise the pressure in the first line 34, and hence the recovery flow rate increases.

FIG. 9 shows the relationship between the hydraulic pump 1, 2 and the recovery flow rate in the above case. As shown in FIG. 9, when the arm control lever unit 22 and the boom control lever unit 21 are operated, the respective pressures of the hydraulic pumps 1, 2 increase with the loads applied to the arm cylinder 4 and the boom cylinder 3. Here, in the case that the load pressure of the arm cylinder 4 is low, the delivery pressure of at least the hydraulic pump 1 is low, whereby the target opening area outputted from the ninth processing unit 88 has nearly its minimum value and the opening area of the recovery control valve 6 also takes its minimum value. As a result, the hydraulic fluid drained from the rod side of the arm cylinder 4 is throttled to raise the pressure in the first line 34, and hence the recovery flow rate increases.

Thus, this second embodiment works such that, during the arm sole operation, the hydraulic fluid is not recovered and the speed of the arm 204 is avoided from increasing excessively. On the other hand, when the load pressure of the arm cylinder 4 is low during the combined operation of the arm and the swing 201 or the boom 203, the recovery flow rate increases and the arm speed can be ensured at a level almost equal to that during the arm sole operation. Accordingly, operability is increased in comparison with that in the related art and hence working efficiency is improved.

A third embodiment of the present invention will be described below with reference to FIG. 10. This third embodiment is intended to obtain substantially the same operation and advantages as those in the above-described first embodiment in a purely hydraulic manner without using any control unit.

Figure 10:
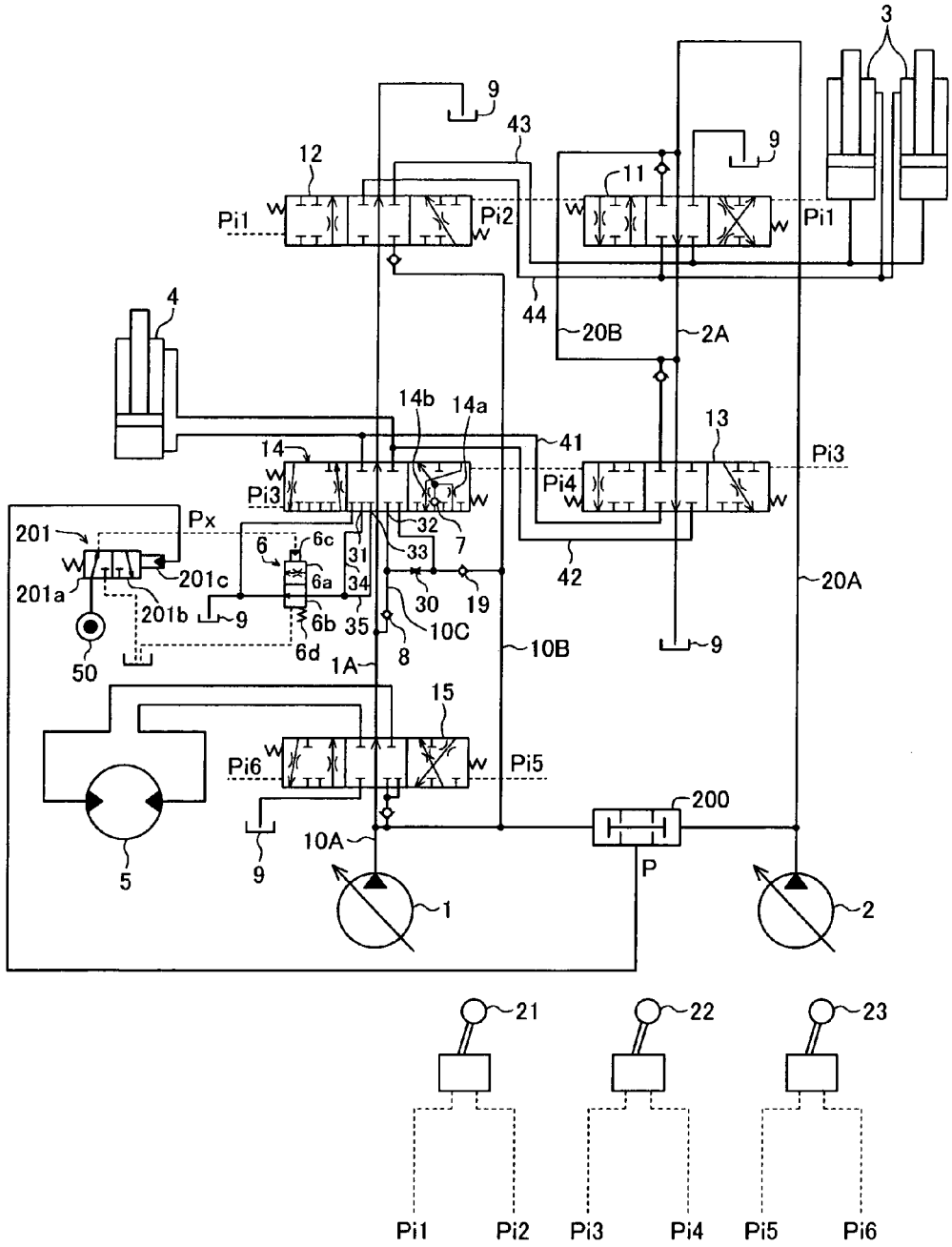
FIG. 10 is an overall hydraulic circuit diagram of a third embodiment of the present invention.

FIG. 10 is an overall hydraulic circuit diagram of the third embodiment. A hydraulic circuit of this embodiment includes a low pressure selecting valve 200 for selectively outputting a lower one of the delivery pressures of the hydraulic pumps 1, 2, and a pressure reducing valve 201 for reducing the primary pilot pressure in accordance with the pressure outputted from the low pressure selecting valve 200. Except for the provision of the low pressure selecting valve 200 and the pressure reducing valve 201 and the omission of the control unit 100 and the pressure sensors 101, 102, the other construction of the hydraulic circuit is the same as that in the above-described first embodiment.

In the third embodiment thus constructed, when the control lever unit 22 is operated to drive the arm 204, a lower one of the delivery pressures of the hydraulic pumps 1, 2 is introduced from the low pressure selecting valve 200 to a hydraulic chamber 201*c* of the pressure reducing valve 201. The valve shift position of the pressure reducing valve 201 is controlled in accordance with a pressure signal P introduced from the low pressure selecting valve 200, whereupon the primary pilot pressure from the pilot pump 50 is reduced and introduced to the hydraulic driving sector 6*c* of the recovery control valve 6. In the case that the pressure P introduced from the low pressure selecting valve 200 is low, therefore, the pilot pressure Px outputted from the pressure reducing valve 201 is relatively high and the opening area of the recovery control valve 6 reduces. As a result, the hydraulic fluid recovered from the first line 34 to the bottom side of the arm cylinder 4 increases as in the above-described first embodiment. Conversely, in the case that the pressure P introduced from the low pressure selecting valve 200 is high, the pilot pressure Px outputted from the pressure reducing valve 201 is relatively low and the opening area of the recovery control valve 6 increases. As a result, the recovery flow rate reduces.

Thus, as with the first embodiment, this third embodiment also works such that, when the load pressure of the arm cylinder 4 is low even in the combined operation of the swing 201 and the arm 204, the hydraulic fluid can be surely returned at a large recovery flow rate to the bottom side of the arm cylinder 4 and the operating speed of the arm cylinder 4 can be increased. Consequently, in any of the arm sole operation and the arm and swing combined operation, the hydraulic fluid can be recovered for return to the arm cylinder 4 and satisfactory operability can be obtained. Hence, working efficiency also increases.

While, in the third embodiment, the primary pilot pressure is reduced by the pressure reducing valve 201 in accordance with the pressure introduced from the low pressure selecting valve 200 and the resulting pilot pressure Px is introduced to the recovery control valve 6, the pressure outputted from the low pressure selecting valve 200 may be used to directly control the recovery control valve 6.

INDUSTRIAL APPLICABILITY

According to the present invention, as described above, during the combined operation of one particular actuator and another actuator, when the load of the particular actuator is low, the hydraulic fluid drained from the particular actuator is used again as the hydraulic fluid for driving the particular actuator. Therefore, the particular actuator can be operated substantially at an equal speed in both the sole operation of the particular actuator and the combined operation of the particular actuator and another actuator. As a result, in comparison with the related art, operability is improved and hence working efficiency is increased.

The invention claimed is:

1. A hydraulic circuit for a working machine comprising a first hydraulic pump for supplying a hydraulic fluid to a plurality of actuators including a particular actuator, a plurality of directional control valves including a particular directional control valve, which are connected in parallel with respect to said first hydraulic pump and control respective flows of the hydraulic fluid supplied to said plurality of actuators, a second hydraulic pump for supplying a hydraulic fluid to another actuator separate from said plurality of actuators, another directional control valve for controlling a flow of the hydraulic fluid supplied from said second hydraulic pump, and a hydraulic recovery system comprising throttle means disposed in a line connecting a reservoir port of said particular directional control valve and a reservoir, and a check valve disposed in a line connecting a reservoir-side line and a pump-side line of said particular directional control valve and allowing the hydraulic fluid to flow from the reservoir-side line to the pump-side line when the pressure in the reservoir-side line is higher than the pressure in the pump-side line, wherein said control circuit further comprises joining means for introducing the hydraulic fluid delivered from said second hydraulic pump to said particular actuator when said particular directional control valve is driven, and wherein said throttle means constituting said hydraulic recovery system is variable throttle means changing an opening area thereof in accordance with a control signal, and said hydraulic recovery system further comprises control signal generating means for generating the control signal supplied to said variable throttle means, first pressure detecting means for detecting the delivery pressure of said first hydraulic pump, second pressure detecting means for detecting the delivery pressure of said second hydraulic pump, and control means for receiving pressure signals from said first and second pressure detecting means, executing predetermined arithmetic processing, and outputting a drive signal to said control signal generating means.

2. A hydraulic circuit for a working machine according to claim 1, wherein said hydraulic recovery system further comprises operation input detecting means disposed in association with said plurality of directional control valves and said another directional control valve and detecting respective operation inputs from operating means for operating the corresponding directional control valves, and said control means receives detected signals from said operation input detecting means and executes the predetermined arithmetic processing based on the respective operation inputs from said operating means in addition to the delivery pressures of said first and second pumps.

3. A hydraulic circuit for a working machine according to claim 1 or 2, wherein said control signal is a hydraulic pilot pressure, and said control signal generating means is a pressure reducing valve for reducing a primary pilot pressure delivered from a pilot pump in accordance with the drive signal from said control means, to thereby produce a secondary pilot pressure serving as said control signal.

4. A hydraulic circuit for a working machine comprising a first hydraulic pump for supplying a hydraulic fluid to a plurality of actuators including a particular actuator, a plurality of directional control valves including a particular directional control valve, which are connected in parallel with respect to said first hydraulic pump and control respective flows of the hydraulic fluid supplied to said plurality of actuators, a second hydraulic pump for supplying a hydraulic fluid to another actuator separate from said plurality of actuators, another directional control valve for controlling a flow of the hydraulic fluid supplied from said second hydraulic pump, and a hydraulic recovery system comprising throttle means disposed in a line connecting a reservoir port of said particular directional control valve and a reservoir, and a check valve disposed in a line connecting a reservoir-side line and a pump-side line of said particular directional control valve and allowing the hydraulic fluid to flow from the reservoir-side line to the pump-side line when pressure in the reservoir-side line is higher than pressure in the pump-side line, wherein said control circuit further comprises joining means for introducing the hydraulic fluid delivered from said second hydraulic pump to said particular actuator when said particular directional control valve is driven, and low pressure selecting means for selecting a lower one of the delivery pressure of said first hydraulic pump and the delivery pressure of said second hydraulic pump, and wherein said throttle means constituting said hydraulic recovery system is variable throttle means changing an opening area thereof in accordance with a pressure signal outputted from said low pressure selecting means.

5. A hydraulic circuit for a working machine according to any one of claims 1, 2, or 4, wherein said working machine is a hydraulic excavator, said particular actuator is an arm hydraulic cylinder for driving an arm, and said plurality of actuators include a swing hydraulic motor.

6. A hydraulic circuit for a working machine according to claim 3, wherein said working machine is a hydraulic excavator, said particular actuator is an arm hydraulic cylinder for driving an arm, and said plurality of actuators include a swing hydraulic motor.

* * * * *